US008709974B2

(12) United States Patent
Kitano

(10) Patent No.: US 8,709,974 B2
(45) Date of Patent: Apr. 29, 2014

(54) THERMOSENSITIVE RECORDING MEDIUM

(75) Inventor: Tohru Kitano, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 312 days.

(21) Appl. No.: 13/048,065

(22) Filed: Mar. 15, 2011

(65) Prior Publication Data

US 2011/0230341 A1 Sep. 22, 2011

(30) Foreign Application Priority Data

Mar. 16, 2010 (JP) ..... 2010-059290

(51) Int. Cl.
*B41M 5/327* (2006.01)
*B41M 5/337* (2006.01)
*B41M 5/42* (2006.01)

(52) U.S. Cl.
USPC ..... 503/226; 503/221

(58) Field of Classification Search
USPC ..... 503/200–226
See application file for complete search history.

(56) References Cited

U.S. PATENT DOCUMENTS

| | | | |
|---|---|---|---|
| 2009/0209419 | A1 | 8/2009 | Kitano |
| 2010/0043642 | A1 | 2/2010 | Takayanagi et al. |
| 2010/0069241 | A1 | 3/2010 | Kitano |
| 2011/0120345 | A1 | 5/2011 | Kodama et al. |

FOREIGN PATENT DOCUMENTS

| | | | |
|---|---|---|---|
| CN | 101037066 | | 9/2007 |
| EP | 2332733 | A1 | 6/2011 |
| GB | 2138292 | A | 10/1984 |
| JP | 9-67797 | | 3/1997 |
| JP | 9-95051 | | 4/1997 |
| JP | 9-123602 | | 5/1997 |
| JP | 11-58964 | | 3/1999 |
| JP | 2001-48710 | | 2/2001 |
| JP | 2005-120008 | | 5/2005 |
| JP | 2005-154602 | | 6/2005 |
| JP | 2005-350358 | | 12/2005 |
| JP | 2007-68723 | | 3/2007 |
| JP | 2007-211004 | | 8/2007 |
| JP | 2008-527191 | | 7/2008 |
| JP | 2009-23237 | | 2/2009 |
| WO | WO 2006/074255 | A1 | 7/2006 |
| WO | WO 2006/123784 | A1 | 11/2006 |
| WO | WO 2007/014847 | | 2/2007 |
| WO | WO 2010/016228 | | 2/2010 |

OTHER PUBLICATIONS

European search report in corresponding European patent application No. 11250299.2.
European search report dated Sep. 20, 2012 in connection with corresponding European patent application No. 11250299.2.
Japanese official action dated Apr. 2, 2013 (including English translation) in corresponding Japanese patent application No. 2008-98345.

*Primary Examiner* — Bruce H Hess
(74) *Attorney, Agent, or Firm* — Cooper & Dunham LLP

(57) ABSTRACT

A thermosensitive recording medium including a support, and a thermosensitive recording layer containing a leuco dye and a developer, and formed on a surface of the support, wherein the thermosensitive recording medium comprises at least any one of diiodomethyl-p-tolylsulfone and 3-iodo-2-propynyl-butyl-carbamate.

12 Claims, No Drawings

THERMOSENSITIVE RECORDING MEDIUM

BACKGROUND OF THE INVENTION

1. Field of the Invention

The present invention relates to a thermosensitive recording medium having antibacterial efficacy.

2. Description of the Related Art

In recent years, along with the diversification of information and the expansion of needs, a variety of types of recording materials have been studied, developed and put to practical use in the field of information recording. Among the recording materials, thermosensitive recording materials are advantageous, for example in that i) simplified recording of images is enabled by a heating process alone, and ii) required apparatuses have simple mechanisms and can therefore be easily made compact and the recording materials are easy to handle and inexpensive. Accordingly, techniques for such recording materials are widely utilized, for example, in the fields of information processing, for output of desk calculators, computers, etc., recorders for medical measurement, low-speed to high-speed facsimiles, automated ticket machines for passenger tickets, admission tickets, etc., thermosensitive copying, labels in the POS system, and tags.

A thermosensitive recording medium generally includes at least a support and a thermosensitive recording layer, and a thermosensitive recording adhesive label includes an adhesive layer and release paper in addition to a support and a thermosensitive recording layer. The release paper is obtained by coating polyethylene-laminated paper, clay-coated paper, high-density base paper such as glassine paper, etc. with a release agent such as a silicone compound or fluorine compound. Examples of an adhesive constituting the adhesive layer include hot-melt adhesives, solvent adhesives and emulsion adhesives such as rubber adhesives, acrylic adhesives and vinyl ether adhesives. Among these, acrylic emulsion adhesives, in particular, are widely used for their safety, quality and inexpensiveness.

Also, the thermosensitive recording medium is generally required to store a recorded image stably; accordingly, there have been proposed a method of coating the thermosensitive recording layer with an aqueous emulsion of a resin which is capable of forming a film and is chemical-resistant, and a method of coating the thermosensitive recording layer with a water-soluble polymer compound such as polyvinyl alcohol. As for the thermosensitive recording adhesive label, the adhesive layer and the release paper are provided on the back surface of the support; as described above, the adhesive constituting the adhesive layer is generally selected from rubber adhesives, acrylic adhesives and the like, particularly acrylic emulsion adhesives. Thus, a low-molecular-weight oligomer, a surfactant and the like contained in the adhesive layer may migrate to the thermosensitive recording layer while the thermosensitive recording adhesive label is stored for a long period of time, even before it starts being used as a label, thereby possibly causing such known problems that the recording sensitivity decreases, and the image density decreases when the label is chemical-resistant, particularly plasticizer-resistant.

Further, more and more antibacterial products, notably fiber and plastic antibacterial products, are becoming widely available, and they are widely utilized in a variety of fields, e.g. for bath-related uses, kitchen equipment, food-related uses, electric appliances, office machines, office equipment and medical uses. In food-related uses, in particular, the antibacterial products are expected to be used as discount-showing labels attached onto wrappings covering foamed trays for foods. In medical uses, the antibacterial products are expected to be used as labels attached onto blood collection tubes, infusion bottles and the like in an attempt to solve the serious problem of in-hospital infection. Also, there is a great problem with the disposal of materials which can be noxious sources of secondary infection, contained in medical waste discharged from medical institutions and the like.

Meanwhile, sheets which contain volatile antibacterial agents have been proposed (refer to JP-A Nos. 2005-120008 and 2007-68723, for example). However, when used as thermosensitive recording materials, they cannot be satisfactorily used because images recorded thereon by thermosensitive recording degrade with time.

Also, tapes and tack seals, in which organic antibacterial insecticides and/or inorganic antibacterial fungicides are mixed with adhesives have been proposed (refer to JP-A No. 2001-48710, for example). However, natural antibacterial agents are used therein, so that when they are used as thermosensitive recording materials, they cannot be satisfactorily used because images recorded thereon by thermosensitive recording degrade with time.

Meanwhile, inclusion of antibacterial agents based upon haloalkylthiophthalimide and/or chlorhexidine gluconate in thermosensitive recording media has been proposed (refer to JP-A Nos. 09-123602 and 11-58964, for example). However, thermosensitive recording layers decrease in sensitivity at high temperatures and high humidity, and fogging of background portions of images occurs.

Further, thermosensitive recording media which contain inorganic ion antibacterial agents have been proposed (refer to JP-A No. 09-95051, for example). However, effects cannot be expected from the thermosensitive recording media unless the antibacterial agents are in direct contact with microorganisms such as bacteria.

Also, dispersions or surface coating treatment agents, which contain inorganic antibacterial agents and imidazole antibacterial agents have been proposed (refer to JP-A No. 2007-211004, for example). However, the dispersions or the surface coating treatment agents contain organic solvents as their essential components, so that when used for thermosensitive recording materials, there is such a problem that fogging of background portions of images recorded by thermosensitive recording arises.

Moreover, inclusion of an iodine compound and an iodine-dextrin clathrate compound has been proposed (refer to JP-A Nos. 2005-154602 and 2005-350358, and International Publication No. WO 2006/123784). However, when this is applied to paper products, the iodine stains the paper products. Even when the iodine is modified to be the dextrin clathrate compound for use in paper products, the same problem still occurs over time.

Further more, to solve the above-mentioned problems, inclusion of diiodomethyl-p-tolylmethylsulfone in paper products has been proposed. (refer to JP-A Nos. 9-67797, and 2008-527191) However, this is not a proposal of inclusion of diiodomethyl-p-tolylmethylsulfone in a thermosensitive recording medium, and does not disclose a problem in the thermosensitive recording medium.

BRIEF SUMMARY OF THE INVENTION

An object of the present invention is to provide a highly practical thermosensitive recording medium having excellent storage stability at high temperature and high humidity and antibacterial properties and is suitable as a label used with food in the POS system, a label attached onto a blood collection tube, an infusion bottle, etc. in the medical field, or the like.

Means for solving the above-mentioned problems are as follows.

<1> A thermosensitive recording medium containing: a support, and a thermosensitive recording layer containing a leuco dye and a developer, and formed on a surface of the support, wherein the thermosensitive recording medium contains at least any one of diiodomethyl-p-tolylsulfone and 3-iodo-2-propynyl-butyl-carbamate.

<2> The thermosensitive recording medium according to <1>, wherein the leuco dye contains at least any one of 3-dibutylamino-6-methyl-7-anilinofluoran and 6-[ethyl(4-methylphenyl)amino]-3-methyl-2-anilinofluoran.

<3> The thermosensitive recording medium according to any one of <1> and <2>, further containing an overcoat layer formed on the thermosensitive recording layer.

<4> The thermosensitive recording medium according to <3>, wherein the overcoat layer contains the at least any one of diiodomethyl-p-tolylsulfone and 3-iodo-2-propynyl-butyl-carbamate.

<5> The thermosensitive recording medium according to any one of <1> to <4>, further containing an undercoat layer formed between the support and the thermosensitive recording layer.

<6> The thermosensitive recording medium according to <5>, wherein the undercoat layer contains the at least any one of diiodomethyl-p-tolylsulfone and 3-iodo-2-propynyl-butyl-carbamate.

<7> The thermosensitive recording medium according to any one of <1> to <6>, further containing a back coat layer formed on a surface of the support, which surface is opposite to a surface on which the thermosensitive recording layer is formed.

<8> The thermosensitive recording medium according to <7>, wherein the back coat layer contains the at least any one of diiodomethyl-p-tolylsulfone and 3-iodo-2-propynyl-butyl-carbamate.

<9> The thermosensitive recording medium according to any one of <1> to <8>, further containing an acrylic adhesive layer and release paper sequentially formed on a surface of the support, which surface is opposite to a surface on which the thermosensitive recording layer is formed.

<10> The thermosensitive recording medium according to <9>, wherein the acrylic adhesive layer contains the at least any one of diiodomethyl-p-tolylsulfone and 3-iodo-2-propynyl-butyl-carbamate.

According to the present invention, it is possible to solve the above-mentioned problems and achieve the above-mentioned object, and provide a highly practical thermosensitive recording medium having excellent storage stability at high temperature and high humidity and antibacterial properties, and which is suitable as a label used with food in the POS system, a label used in the medical field, or the like.

DETAILED DESCRIPTION OF THE INVENTION

A thermosensitive recording medium of the present invention includes a support, a thermosensitive recording layer containing a leuco dye and a developer, and formed on a surface of the support. Further, the thermosensitive recording medium includes other components if necessary.

In the present invention, the thermosensitive recording medium, namely, at least any one of layers constituting the thermosensitive recording medium contains at least any one of diiodomethyl-p-tolylsulfone and 3-iodo-2-propynyl-butyl-carbamate.

The layer constituting the thermosensitive recording medium is not particularly limited and may be suitably selected according to the intended purpose. Examples thereof include a thermosensitive recording layer, an overcoat layer, an undercoat layer, a back coat layer, and an adhesive layer. The diiodomethyl-p-tolylsulfone and/or 3-iodo-2-propynyl-butyl-carbamate can be incorporated in one or two or more of these layers. Of these, the overcoat layer, the undercoat layer, the back coat layer, and the adhesive layer are preferable.

<Thermosensitive Recording Layer>

The thermosensitive recording layer includes the leuco dye and the developer and, if necessary, includes other components.

—Leuco Dye—

The leuco dye is a compound which exhibits electron-donating properties. As the leuco dye, a single such compound may be used, or two or more such compounds may be used in a mixed manner. The leuco dye itself is a colorless or pale dye precursor and can be selected from conventionally known leuco dyes without any limitation in particular. Preferred examples thereof include leuco compounds such as triphenylmethane phthalide compounds, triallylmethane compounds, fluoran compounds, phenothiazine compounds, thiofluoran compounds, xanthene compounds, indophthalyl compounds, spiropyran compounds, azaphthalide compounds, chromenopyrazole compounds, methine compounds, rhodamineanilinolactam compounds, rhodaminelactam compounds, quinazoline compounds, diazaxanthene compounds and bislactone compounds.

The leuco compounds are not particularly limited and may be suitably selected according to the intended purpose. Specific examples of the leuco compounds include 3-dibutylamino-6-methyl-7-anilinofluoran, 6-[ethyl(4-methylphenyl)amino]-3-methyl-2-anilinofluoran, 2-anilino-3-methyl-6-diethylaminofluoran, 2-anilino-3-methyl-6-(N-n-propyl-N-methylamino)fluoran, 2-anilino-3-methyl-6-(N-isopropyl-N-methylamino)fluoran, 2-anilino-3-methyl-6-(N-isobutyl-N-methylamino)fluoran, 2-anilino-3-methyl-6-(N-n-amyl-N-methylamino)fluoran, 2-anilino-3-methyl-6-(N-s-butyl-N-ethylamino)fluoran, 2-anilino-3-methyl-6-(N-n-amyl-N-ethylamino)fluoran, 2-anilino-3-methyl-6-(N-isoamyl-N-ethylamino)fluoran, 2-anilino-3-methyl-6-(N-cyclohexyl-N-methylamino)fluoran, 2-anilino-3-methyl-6-(N-methyl-p-toluidino)fluoran, 2-(m-trichloromethylanilino)-3-methyl-6-diethylaminofluoran, 2-(m-trifluoromethylanilino)-3-methyl-6-diethylaminofluoran, 2-(m-trifluoromethylanilino)-3-methyl-6-(N-cyclohexyl-N-methylamino) fluoran, 2-(2,4-dimethylanilino)-3-methyl-6-diethylaminofluoran, 2-(N-ethyl-p-toluidino)-3-methyl-6-(N-ethylanilino)fluoran, 2-(N-methyl-p-toluidino)-3-methyl-6-(N-propyl-p-toluidino)fluoran, 2-anilino-6-(N-n-hexyl-N-ethylamino)fluoran, 2-(o-chloroanilino)-6-diethylaminofluoran, 2-(o-bromoanilino)-6-diethylaminofluoran, 2-(o-chloroanilino)-6-dibutylaminofluoran, 2-(o-fluoroanilino)-6-dibutylaminofluoran, 2-(m-trifluoromethylanilino)-6-diethylaminofluoran, 2-(p-acetylanilino)-6-(N-n-amyl-N-n-butylamino)fluoran, 2-benzylamino-6-(N-ethyl-p-toluidino)fluoran, 2-benzylamino-6-(N-methyl-2,4-dimethylanilino)fluoran, 2-benzylamino-6-(N-ethyl-2,4-dimethylanilino)fluoran, 2-dibenzylamino-6-(N-methyl-p-toluidino)fluoran, 2-dibenzylamino-6-(N-ethyl-p-toluidino)fluoran, 2-(di-p-methylbenzylamino)-6-(N-ethyl-p-toluidino)fluoran, 2-(α-phenylethylamino)-6-(N-ethyl-p-toluidino)fluoran, 2-methylamino-6-(N-methylanilino)fluoran, 2-methylamino-6-(N-ethylanilino)fluoran, 2-methylamino-6-(N-propylanilino)fluoran, 2-ethylamino-6-(N-methyl-p-toluidino)fluoran, 2-methylamino-6-(N-methyl-2,4-dimethylanilino)fluoran, 2-ethylamino-6-(N-methyl-2,4-dimethylanilino)fluoran, 2-dimethylamino-6-(N-methylanilino)fluoran, 2-dimethylamino-6-(N-ethylanilino)fluoran, 2-diethylamino-6-(N-methyl-p-toluidino)fluoran, 2-diethylamino-6-(N-ethyl-p-toluidino)fluoran, 2-dipropylamino-6-(N-methylanilino)fluoran, 2-dipropylamino-6-(N-ethylanilino)fluoran, 2-amino-6-(N-methylanilino)fluoran, 2-amino-6-(N-ethylanilino)fluoran, 2-amino-6-(N-propylanilino)fluoran, 2-amino-6-(N-methyl-p-toluidino)fluoran, 2-amino-6-(N-ethyl-p-toluidino)fluoran, 2-amino-6-(N-propyl-p-toluidino)fluoran, 2-amino-6-(N-methyl-p-ethylanilino)fluoran, 2-amino-6-(N-ethyl-p-ethylanilino)fluoran, 2-amino-6-(N-propyl-p-ethylanilino)fluoran, 2-amino-6-(N-methyl-2,4-dimethylanilino)fluoran, 2-amino-6-(N-ethyl-2,4-dimethylanilino)fluoran, 2-amino-6-(N-propyl-2,4-dimethylanilino)fluoran, 2-amino-6-(N-methyl-p-chloroanilino)fluoran, 2-amino-6-(N-ethyl-p-chloroanilino)fluoran, 2-amino-6-(N-propyl-p-chloroanilino)fluoran, 2,3-dimethyl-6-dimethylaminofluoran, 3-methyl-6-(N-ethyl-p-toluidino)fluoran, 2-chloro-6-diethylaminofluoran, 2-bromo-6-diethylaminofluoran, 2-chloro-6-dipropylaminofluoran, 3-chloro-6-cyclohexylaminofluoran, 3-bromo-6-cyclohexylaminofluoran, 2-chloro-6-(N-ethyl-N-isoamylamino)fluoran, 2-chloro-3-methyl-6-diethylaminofluoran, 2-anilino-3-chloro-6-diethylaminofluoran, 2-(o-chloroanilino)-3-chloro-6-cyclohexylaminofluoran, 2-(m-trifluoromethylanilino)-3-chloro-6-diethylaminofluoran, 2-(2,3-dichloroanilino)-3-chloro-6-diethylaminofluoran, 1,2-benzo-6-diethylaminofluoran, 1,2-benzo-6-(N-ethyl-N-isoamylamino)fluoran, 1,2-benzo-6-dibutylaminofluoran, 1,2-benzo-6-(N-ethyl-N-cyclohexylamino)fluoran, 1,2-benzo-6-(N-ethyl-toluidino)fluoran, 2-anilino-3-methyl-6-(N-2-ethoxypropyl-N-ethylamino)fluoran, 2-(p-chloroanilino)-6-(N-n-octylamino)fluoran, 2-(p-chloroanilino)-6-(N-n-palmitylamino)fluoran, 2-(p-chloroanilino)-6-(di-n-octylamino)fluoran, 2-benzoylamino-6-(N-ethyl-p-toluidino)fluoran, 2-(o-methoxybenzoylamino)-6-(N-ethyl-p-toluidino)fluoran, 2-dibenzylamino-4-methyl-6-diethylaminofluoran, 2-dibenzylamino-4-methoxy-6-(N-methyl-p-toluidino)fluoran, 2-dibenzylamino-4-methyl-6-(N-ethyl-p-toluidino)fluoran, 2-(α-phenylethylamino)-4-methyl-6-diethylaminofluoran, 2-(p-toluidino)-3-(t-butyl)-6-(N-methyl-p-toluidino)fluoran, 2-(o-methoxycarbonylanilino)-6-diethylaminofluoran, 2-acetylamino-6-(N-methyl-p-toluidino)fluoran, 3-diethylamino-6-(m-trifluoromethylanilino)fluoran, 4-methoxy-6-(N-ethyl-p-toluidino)fluoran, 2-ethoxyethylamino-3-chloro-6-dibutylaminofluoran, 2-dibenzylamino-4-chloro-6-(N-ethyl-p-toluidino)fluoran, 2-(α-phenylethylamino)-4-chloro-6-diethylaminofluoran, 2-(N-benzyl-p-trifluoromethylanilino)-4-chloro-6-diethylaminofluoran, 2-anilino-3-methyl-6-pyrrolidinofluoran, 2-anilino-3-chloro-6-pyrrolidinofluoran, 2-anilino-3-methyl-6-(N-ethyl-N-tetrahydrofurfurylamino)fluoran, 2-mesidino-4',5'-benzo-6-diethylaminofluoran, 2-(m-trifluoromethylanilino)-3-methyl-6-pyrrolidinofluoran, 2-(α-naphthylamino)-3,4-benzo-4'-bromo-6-(N-benzyl-N-cyclohexylamino)fluoran, 2-piperidino-6-diethylaminofluoran, 2-(N-n-propyl-p-trifluoromethylanilino)-6-morpholinofluoran, 2-(di-N-p-chlorophenyl-methylamino)-6-pyrrolidinofluoran, 2-(N-n-propyl-m-trifluoromethylanilino)-6-morpholinofluoran, 1,2-benzo-6-(N-ethyl-N-n-octylamino)fluoran, 1,2-benzo-6-diallylaminofluoran, 1,2-benzo-6-(N-ethoxyethyl-N-ethylamino)fluoran, benzoleuco methylene blue, 2-[3,6-bis(diethylamino)]-6-(o-chloroanilino)xanthyl benzoic acid lactam, 2-[3,6-bis(diethylamino)]-9-(o-chloroanilino)xanthyl benzoic acid lactam, 3,3-bis(p-dimethylaminophenyl)phthalide, 3,3-bis(p-dimethylaminophenyl)-6-dimethylaminophthalide, 3,3-bis(p-dimethylaminophenyl)-6-diethylaminophthalide, 3,3-bis(p-dimethylaminophenyl)-6-chlorophthalide, 3,3-bis(p-dibutylaminophenyl)phthalide, 3-(2-methoxy-4-dimethylaminophenyl)-3-(2-hydroxy-4,5-dichlorophenyl) phthalide, 3-(2-hydroxy-4-dimethylaminophenyl)-3-(2-methoxy-5-chlorophenyl) phthalide, 3-(2-hydroxy-4-dimethoxyaminophenyl)-3-(2-methoxy-5-chlorophenyl) phthalide, 3-(2-hydroxy-4-dimethylaminophenyl)-3-(2-methoxy-5-nitrophenyl) phthalide, 3-(2-hydroxy-4-diethylaminophenyl)-3-(2-methoxy-5-methylphenyl) phthalide, 3,6-bis(dimethylamino) fluorenespiro(9,3')-6'-dimethylaminophthalide, 6'-chloro-8'-methoxy-benzoindolino-spiropyran and 6'-bromo-2'-methoxy-benzoindolino-spiropyran. These may be used alone or in combination. Of these, 3-dibutylamino-6-methyl-7-anilinofluoran, 6-[ethyl(4-methylphenyl)amino]-3-methyl-2-anilinofluoran, 2-anilino-3-methyl-6-diethylaminofluoran are particularly preferable, in terms of excellent storage stability at high temperature and high humidity.

The developer can be selected from a variety of electron-accepting substances capable of reacting with the leuco dye when heated and making the leuco dye form color. Specific examples of the developer include the following phenolic compounds, organic acid compounds, inorganic acid compounds, and esters and salts of these compounds.

The developer is not particularly limited and may be suitably selected according to the intended purpose. Examples thereof include gallic acid, salicylic acid, 3-isopropyl salicylic acid, 3-cyclohexyl salicylic acid, 3,5-di-t-butyl salicylic acid, 3,5-di-α-methylbenzyl salicylic acid, 4,4'-isopropylidenediphenol, 1,1'-isopropylidenebis(2-chlorophenol), 4,4'-isopropylidenebis(2,6-dibromophenol), 4,4'-isopropylidenebis(2,6-dichlorophenol), 4,4'-isopropylidenebis(2-methylphenol), 4,4'-isopropylidenebis(2,6-dimethylphenol), 4,4'-isopropylidenebis(2-t-butylphenol), 4,4'-s-butylidenediphenol, 4,4'-cyclohexylidenebisphenol, 4,4'-cyclohexylidenebis(2-methylphenol), 4-t-butylphenol, 4-phenylphenol, 4-hydroxydiphenoxide, α-naphthol, β-naphthol, 3,5-xylenol, thymol, methyl-4-hydroxybenzoate, 4-hydroxyacetoacetophenone, novolac-type phenolic resins, 2,2'-thiobis(4,6-dichlorophenol), catechol, resorcin, hydroquinone, pyrogallol, fluoroglycine, fluoroglycine carboxylic acid, 4-t-octylcatechol, 2,2'-methylenebis(4-chlorophenol), 2,2'-methylenebis(4-methyl-6-t-butylphenol), 2,2'-dihydroxydiphenyl, ethyl p-hydroxybenzoate, propyl p-hydroxybenzoate, butyl p-hydroxybenzoate, benzyl p-hydroxybenzoate, p-chlorobenzyl p-hydroxybenzoate, o-chlorobenzyl p-hydroxybenzoate, p-methylbenzyl p-hydroxybenzoate, n-octyl p-hydroxybenzoate, benzoic acid, zinc salicylate, 1-hydroxy-2-naphthoic acid, 2-hydroxy-6-naphthoic acid, 2-hydroxy-6-zinc naphthoate, 4-hydroxydiphenylsulfone, 4-hydroxy-4'-chlorodiphenylsulfone, bis(4-hydroxyphenyl) sulfide, 2-hydroxy-p-toluic acid, 3,5-di-t-zinc butyl salicylate, 3,5-di-t-tin butyl salicylate, tartaric acid, oxalic acid, maleic acid, citric acid, succinic acid, stearic acid, 4-hydroxyphthalic acid, boric acid, thiourea derivatives, 4-hydroxythiophenol derivatives, bis(4-hydroxyphenyl)acetic acid, bis(4-hydroxyphenyl)ethyl acetate, bis(4-hydroxyphenyl)n-propyl acetate, bis(4-hydroxyphenyl)n-butyl acetate, bis(4-hydroxyphenyl)phenyl acetate, bis(4-hydroxyphenyl)benzyl acetate, bis(4-hydroxyphenyl)phenethyl acetate, bis(3-methyl-4-hydroxyphenyl)acetate, bis(3-methyl-4-hydroxyphenyl)methyl acetate, bis(3-methyl-4-hydroxyphenyl)n-propyl acetate, 1,7-bis(4-hydroxyphenylthio)-3,5-dioxaheptane, 1,5-bis(4-hydroxyphenylthio)-3-oxapentane, dimethyl 4-hydroxyphthalate, 4-hydroxy-4'-methoxydiphenylsulfone, 4-hydroxy-4'-ethoxydiphenylsulfone, 4-hydroxy-4'-isopropoxydiphenylsulfone, 4-hydroxy-4'-propoxydiphenylsulfone, 4-hydroxy-4'-butoxydiphenylsulfone, 4-hydroxy-4'-isobutoxydiphenylsulfone, 4-hydroxy-4'-s-butoxydiphenylsulfone, 4-hydroxy-4'-t-butoxydiphenylsulfone, 4-hydroxy-4'-benzyloxydiphenylsulfone, 4-hydroxy-4'-phenoxydiphenylsulfone, 4-hydroxy-4'-(m-methylbenzyloxy)diphenylsulfone, 4-hydroxy-4'-(p-methylbenzyloxy)diphenylsulfone, 4-hydroxy-4'-(o-methylbenzyloxy)diphenylsulfone and 4-hydroxy-4'-(p-chlorobenzyloxy)diphenylsulfone. These may be used alone or in combination.

Other components which can be used for the thermosensitive recording layer are not particularly limited and may be suitably selected according to the intended purpose. Examples thereof include auxiliary additives commonly used for this sort of thermosensitive recording material, such as a water-soluble polymer, an aqueous resin emulsion, a filler, a thermofusible substance and a surfactant. The above-mentioned other components may be used alone or in combination.

The water-soluble polymer and the aqueous resin emulsion are not particularly limited and may be selected from known compounds generally used for thermosensitive recording layers.

The filler is not particularly limited and may be suitably selected according to the intended purpose. Examples thereof include inorganic fine powders such as powders of calcium carbonate, silica, zinc oxide, titanium oxide, aluminum hydroxide, zinc hydroxide, barium sulfate, clay, talc, and surface-treated calcium and silica; and organic fine powders such as powders of urea-formalin resins, styrene-methacrylic acid copolymers and polystyrene resins.

The thermofusible substance is not particularly limited and may be suitably selected according to the intended purpose. Examples thereof include fatty acids such as stearic acid and behenic acid; fatty acid amides such as stearic acid amide and palmitic acid amide; fatty acid metal salts such as zinc stearate, aluminum stearate, calcium stearate, zinc palmitate and zinc behenate; p-benzylbiphenyl, m-terphenyl, triphenylmethane, benzyl p-benzyloxybenzoate, β-benzyloxy naphthalene, phenyl β-naphthoate, 1-hydroxy-2-phenyl naphthoate, 1-hydroxy-2-methyl naphthoate, diphenyl carbonate, guaiacol carbonate, dibenzyl terephthalate, dimethyl terephthalate, 1,4-dimethoxynaphthalene, 1,4-diethoxynaphthalene, 1,4-dibenzyloxynaphthalene, 1,2-diphenoxyethane, 1,2-bis(3-methylphenoxy)ethane, 1,2-bis(4-methylphenoxy) ethane, 1,4-diphenoxy-2-butene, 1,2-bis(4-methoxyphenylthio)ethane, dibenzoylmethane, 1,4-diphenylthiobutane, 1,4-diphenylthio-2-butene, 1,3-bis(2-vinyloxyethoxy)benzene, 1,4-bis(2-vinyloxyethoxy)benzene, p-(2-vinyloxyethoxy)biphenyl, p-aryloxybiphenyl, p-propargyloxybiphenyl, dibenzoyloxymethane, dibenzoyloxypropane, dibenzyl disulfide, 1,1-diphenylethanol, 1,1-diphenylpropanol, p-benzyloxybenzyl alcohol, 1,3-phenoxy-2-propanol, N-octadecylcarbamoyl-p-methoxycarbonylbenzene, N-octadecylcarbamoylbenzene, 1,2-bis(4-methoxyphenoxy)propane, 1,5-bis(4-methoxyphenoxy)-3-oxapentane, 1,2-bis(3,4-dimethylphenyl)ethane, dibenzyl oxalate, bis(4-methylbenzyl) oxalate, bis(4-chlorobenzyl) oxalate and 4-acetotoluidide; and other thermofusible organic compounds having melting points of approximately 50° C. to 200° C. These may be used alone or in combination.

Examples of the surfactant include fatty acid metal soaps, polycarboxylic polymer activators, higher alcohol sulfate salts, alkylpolyether sulfate salts, higher alcohol ethyleneoxide adducts, alkylaryl sulfonate salts, alkylsulfonic acids, arylsulfonic acids, phosphates, aliphatic phosphates, aromatic phosphates, polyoxyethylene alkylsulfates, polyoxyethylene arylsulfates, polyoxyethylene alkylarylsulfate, dialkyl sulfosuccinate, alkylbenzene sulfonates, polyoxyalkylene alkylether phosphate, polyoxyalkylene arylether phosphate, polyoxyalkylene alkylarylether phosphate, sodium alkyl sulfate, dioctyl sulfosuccinate sodium salt, polyalkylene glycol such as polyoxyethylenenonylphenylether, acetylene glycol, ethylene oxide adducts of acetylene glycol, propylene oxide adducts of acetylene glycol and ethylene oxide and propylene oxide adducts of acetylene glycol. These may be used alone or in combination.

<Support>

Base paper favorably used as the support is composed mainly of wood pulp and a loading filler. The wood pulp is not particularly limited and may be suitably selected according to the intended purpose. Examples of the wood pulp include chemical pulps such as LBKP and NBKP, mechanical pulps such as GP, PGW, RMP, TMP, CTMP, CMP and CGP, and recycled pulps such as DIP. Also, one or more conventionally known additives such as a pigment, a binder, a sizing agent, a fixing agent, a yield enhancer, a cationizing agent and a paper strength agent may be added to the support, if necessary.

The support can be produced using an apparatus such as a Fourdrinier paper machine, a cylinder paper machine or a twin-wire paper machine and made acidic, neutral or alkaline.

The base paper may be subjected to on-machine calendering using a calendering apparatus including a metal roll and a synthetic resin roll. Alternatively, the base paper may be subjected to off-machine calendering and then subjected to machine calendering, super calendering, etc. so as to control its flatness.

The loading filler contained in the base paper is not particularly limited and may be suitably selected according to the intended purpose. Examples thereof include white inorganic pigments such as light calcium carbonate, heavy calcium carbonate, kaolin, talc, calcium sulfate, barium sulfate, titanium dioxide, zinc oxide, zinc sulfide, satin white, aluminum silicate, diatomaceous earth, calcium silicate, magnesium silicate, synthetic silica, aluminum hydroxide, alumina, lithopone, zeolite, magnesium carbonate and magnesium hydroxide; and organic pigments such as styrene plastic pigments, acrylic plastic pigments, polyethylene, microcapsules, urea resins and melamine resins.

The sizing agent for use in the base paper is not particularly limited and may be suitably selected according to the intended purpose. Examples thereof include rosin sizing agents for acidic papermaking, modified rosin sizing agents for neutral papermaking, AKD, ASA and cationic polymer sizing agents.

Commonly used paper such as commercially available wood free paper, glassine paper, art paper, coated paper or cast paper may also be used as the support, and raw materials generally used in papermaking, such as a loading filler, a sizing agent, a paper strength agent and a dye, may be additionally used if necessary. Other examples of the support include plastic sheets made of polyethylene, polypropylene, polyethylene terephthalate or polyamides; unwoven fabrics and synthetic paper made of synthetic fibers of these substances; laminated paper with its one or both surfaces coated with a synthetic resin; metal foil; metal foil with paper; vapordeposited paper; holographic opaque sheets; products with synthetic resin films; mica paper; and glass paper.

The structure of the thermosensitive recording medium is not particularly limited and may be suitably selected according to the intended purpose. Examples thereof include an overcoat layer, an undercoat layer, a back coat layer, an adhesive layer and release paper. Hereinafter, these layers will be specifically described.

—Overcoat Layer—

The thermosensitive recording medium preferably further includes an overcoat layer on the thermosensitive recording layer. The provision of the overcoat layer makes it possible to prevent a color formation hindering factor, contained in the thermosensitive recording medium that is stored or used generally in the form of a roll, from penetrating through release paper and having an adverse effect on the thermosensitive recording layer. Without an overcoat layer being provided on the thermosensitive recording layer, sufficient barrier properties cannot be obtained, which may cause a reduction in coloring properties depending upon the use environment.

The overcoat layer contains a resin and a filler, and if necessary further contains other components.

The resin is preferably polyvinyl alcohol, and produced, for example, by a known method and may contain a monomer capable of copolymerizing with a vinyl ester, besides a saponified material of polyvinyl acetate. Examples of the monomer include olefins such as ethylene, propylene and isobutylene; unsaturated acids such as acrylic acid, methacrylic acid, crotonic acid, maleic acid, maleic anhydride and itaconic acid, and salts thereof nitriles such as acrylonitrile and methacrylonitrile; amides such as acrylamide and methacrylamide; and olefin sulfonic acids such as ethylene sulfonic acid, allyl sulfonic acid and methallyl sulfonic acid, and salts thereof.

Examples of the filler include inorganic fillers such as phosphate fiber, potassium titanate, needle-like magnesium hydroxide, whiskers, talc, mica, glass flakes, calcium carbonate, plate-like calcium carbonate, aluminum hydroxide, plate-like aluminum hydroxide, silica, clay, kaolin, talc, baked clay and hydrotalcites; and organic fillers such as cross-linked polystyrene resins, urea resins, silicone resins, cross-linked polymethyl methacrylate resins and melamine-formaldehyde resins.

Additionally, it is particularly preferable to add a water resistant agent in order to improve the water resistance of the overcoat layer. Specific examples of the water resistant agent include glyoxal, melamine-formaldehyde resins, polyamide resins and polyamide-epichlorohydrin resins.

Further, in combination with the resin and the filler, conventionally used auxiliary additives such as a surfactant, a thermofusible substance, a lubricant and a pressure-related color formation preventing agent may also be used for the overcoat layer. Specific examples of the thermofusible substance are similar to those already mentioned in relation to the thermosensitive recording layer.

The amount of the overcoat layer attached is preferably in the range of 1.0 g/m$^2$ to 5.0 g/m$^2$ after dried. When the amount is smaller than 1.0 g/m$^2$, there is degradation of the storage stability of a recorded image against water and acidic substances contained in foods, and plasticizers, oils and fats, etc. contained in organic polymer materials used for wrapping. When the amount is larger than 5.0 g/m$^2$, there is degradation of color formation sensitivity.

—Undercoat Layer—

Additionally, the thermosensitive recording medium preferably includes an undercoat layer which contains a binder, a filler, a thermofusible substance, etc. between the support and the thermosensitive recording layer according to necessity, for the purpose of preventing an adhesive from migrating to the thermosensitive recording layer, improving color formation sensitivity, flatness and adhesion, and so forth.

It is desirable to use hollow particles as the filler of the undercoat layer. For instance, hollow particles including shells made of a thermoplastic resin and having a hollow ratio of 30% or greater, generally in the range of 33% to 99%, and a mass average particle diameter of 0.4 μm to 10 μm may be used. The hollow ratio (%) herein mentioned is the ratio of the diameter of the hollow portion of each hollow particle to the outer diameter of each hollow particle, which is represented by (Diameter of hollow portion of hollow particle/Outer diameter of hollow particle)×100.

As the binder and the thermofusible substance, ones similar to those mentioned in relation to the overcoat layer may be used.

The undercoat layer is desirably provided such that the amount thereof attached is in the range of 2 g/m$^2$ to 10 g/m$^2$ after dried. It is more desirable that the undercoat layer contain hollow particles having a hollow ratio of 80% or greater and a mass average particle diameter of 0.8 μm to 5 μm and that the amount of the undercoat layer attached be in the range of 2.5 g/m$^2$ to 7 g/m$^2$ after dried. This makes it possible to provide a thermosensitive recording medium having high color formation sensitivity when printed with an image.

The hollow particles preferably occupy 35% by mass to 80% by mass of the overall composition of the undercoat layer. The specific gravity of the hollow particles changes depending upon their hollow ratio, and the mass ratio of the hollow particles decreases as their hollow ratio increases. When the hollow particles occupy less than 35% by mass, sensitivity-related effects are hard to obtain. When the hollow particles occupy more than 80% by mass, layer adhesion is impaired.

—Back Coat Layer—

The thermosensitive recording medium preferably includes a back coat layer on a surface of the support, which surface is opposite to a surface on which the thermosensitive recording layer is formed. In the case where the thermosensitive recording medium is not provided with the back coat layer, a color formation hindering factor contained in an adhesive layer may infiltrate into the thermosensitive recording layer and hinder color formation when the medium is provided with adhesiveness, and used after stored for a long period of time.

The amount of the back coat layer attached is preferably in the range of 0.5 g/m$^2$ to 3.5 g/m$^2$, more preferably in the range of 1.0 g/m$^2$ to 3.4 g/m$^2$, after dried. When the amount is smaller than 0.5 g/m$^2$, curling cannot be reduced in a low-humidity environment. When the amount is larger than 3.5 g/m$^2$, blocking is easily caused when the medium is stored in the form of a roll.

The back coat layer mainly contains a polyvinyl alcohol resin and a curing agent for the polyvinyl alcohol resin.

The polyvinyl alcohol resin used for the back coat layer is produced by a known method and may contain a monomer capable of copolymerizing with a vinyl ester, besides a saponified material of polyvinyl acetate.

Examples of the monomer include olefins such as ethylene, propylene and isobutylene; unsaturated acids such as acrylic acid, methacrylic acid, crotonic acid, maleic acid, maleic anhydride and itaconic acid, and salts thereof; nitriles such as acrylonitrile and methacrylonitrile; amides such as acrylamide and methacrylamide; and olefin sulfonic acids such as ethylene sulfonic acid, allyl sulfonic acid and methallyl sulfonic acid, and salts thereof.

Additionally, a curing agent such as glyoxal, boric acid, alum, polyamide resin, an epoxy resin or dialdehyde starch may be added to the back coat layer to enhance its barrier properties.

Auxiliary agents may if necessary be added into the back coat layer coating solution containing mainly the above-mentioned materials as long as the effects of the present invention are not hindered.

The auxiliary agents are not particularly limited and may be suitably selected according to the intended purpose. Examples thereof include zinc stearate and calcium stearate; waxes such as polyethylene wax, carnauba wax, paraffin wax and ester wax; dispersants such as sodium dioctyl sulfosuccinate, dodecylbenzenesulfonic acid sodium salt, lauryl alcohol sulfuric acid ester sodium salt, alginic acid salt and fatty acid metal salts; ultraviolet absorbers such as benzophenone-based compounds and benzotriazole-based compounds; inorganic pigments such as magnesium carbonate, calcite light calcium carbonate, aragonite light calcium carbonate, heavy calcium carbonate, aluminum hydroxide, titanium dioxide, silicon dioxide, barium sulfate, zinc sulfate, talc, kaolin, clay, baked kaolin, alkali-modified silica, anhydrous silica fine particles and colloidal silica; and organic pigments such as styrene microballs, nylon powder, polyethylene powder and urea-formalin resin fillers.

—Adhesive Layer—

The thermosensitive recording medium may further include an acrylic adhesive layer on a surface of the support, which surface is opposite to a surface on which the thermosensitive recording layer is formed. The provision of the adhesive layer makes it possible for the thermosensitive recording medium to be suitably used as a thermosensitive recording adhesive label.

The adhesive layer is not particularly limited as long as it is formed over a surface of the support, which surface is opposite to a surface on which the thermosensitive recording layer is formed, and the adhesive layer may be suitably selected according to the intended purpose. The adhesive layer may be formed on the back coat layer provided on a surface of the support, which surface is opposite to a surface on which the thermosensitive recording layer is formed.

The adhesive used for the adhesive layer preferably contains as its main component(s) at least one selected from the group consisting of acrylic acid ester-methacrylic acid ester-styrene copolymers, acrylic acid ester-styrene copolymers, and acrylic resins obtained by emulsifying and polymerizing monomers each composed mainly of at least one type of alkyl group-containing (meth)acrylic acid alkyl ester. Here, the term "main component(s)" means that the adhesive layer only contains the resin(s) except for additives such as a penetrant, a film formation auxiliary agent, an antifoaming agent, an antirust agent, a thickening agent, a wetting agent, a preservative, an ultraviolet absorber, a light stabilizer, a pigment and an inorganic filler which are added if necessary. The term "(meth)acrylic" in the present specification means either acrylic or methacrylic.

Specific examples of the (meth)acrylic acid alkyl ester include n-pentyl(meth)acrylate, n-hexyl(meth)acrylate, 2-ethylhexyl(meth)acrylate, n-octyl(meth)acrylate, isooctyl (meth)acrylate, n-decyl(meth)acrylate and n-dodecyl(meth) acrylate. These may be used alone or in combination.

Also, besides any of these components, a carboxyl group-containing radically polymerizable unsaturated monomer, and/or a radically polymerizable unsaturated monomer capable of copolymerizing with a meth(acrylic) acid alkyl ester and/or with a carboxyl group-containing radically polymerizable unsaturated monomer may if necessary be added.

Specific examples of the carboxyl group-containing radically polymerizable unsaturated monomer include α,β-unsaturated carboxylic acids such as (meth)acrylic acid; and α,β-unsaturated dicarboxylic acids such as itaconic acid, maleic acid and 2-methyleneglutaric acid. These may be used alone or in combination.

Here, the amount of the adhesive attached is preferably in the range of 8 $g/m^2$ to 30 $g/m^2$ after dried. When the amount is smaller than 8 $g/m^2$, sufficient adhesion cannot be obtained, and so the thermosensitive recording medium may not be able to be affixed to an object with a rough surface such as corrugated paper. When the amount is larger than 30 $g/m^2$, the thermosensitive recording medium has greater adhesion than necessary, which is unfavorable from an economical viewpoint.

The method of applying the adhesive is not particularly limited and may be suitably selected according to the intended purpose. For instance, the adhesive is applied using a roll coater, knife coater, bar coater, slot dye coater, curtain coater or the like and may be applied onto a surface of the after-mentioned release paper, which surface is coated with a release agent or onto the back surface of the support, i.e., the surface of the support, which surface is opposite to a surface on which the thermosensitive recording layer is formed.

—Release Paper—

In the case where the thermosensitive recording medium includes the adhesive layer, it is desirable that release paper be laid on the adhesive layer provided over a surface of the support, which surface is opposite to a surface on which the thermosensitive recording layer is formed.

As for production of the release paper, first of all, what is prepared is a base material which is formed by providing high-grade base paper such as glassine paper or base paper such as clay-coated paper, kraft paper or wood free paper, with a filler layer formed of a natural or synthetic resin, e.g. casein, dextrin, starch, carboxymethyl cellulose, methyl cellulose, ethyl cellulose, hydroxyethyl cellulose, polyvinyl alcohol, styrene-butadiene copolymer, ethylene-vinyl chloride copolymer, methylmethacrylate-butadiene copolymer, ethylene-vinyl acetate copolymer or (meth)acrylic acid ester copolymer, or formed of such a resin and an inorganic pigment, e.g. kaolin, clay, calcium carbonate, baked clay (baked kaolin), titanium oxide or silica, or an organic pigment, e.g. plastic pigment; alternatively, what is prepared is polymer laminated paper obtained by coating kraft paper or wood free paper with a synthetic resin such as polyethylene. Subsequently, a solvent or solventless silicone resin, fluorine resin or the like is applied onto the acrylic adhesive layer such that the amount of the resin attached is in the range of approximately 0.05 $g/m^2$ to 3 $g/m^2$ after dried, and then the resin is subjected to thermal curing, electron beam curing, ultraviolet curing, etc. so as to form a release agent layer on the base material or the polymer laminated paper.

A device for applying the release agent is not particularly limited, and may be suitably selected according to the intended purpose. Examples thereof include a bar coater, direct gravure coater, offset gravure coater, air knife coater, and multiple roll coater.

By incorporating an antibacterial agent in the thermosensitive recording medium, the thermosensitive recording medium can exhibit antibacterial efficacy. In order to strike a balance between antibacterial efficacy and prevention of any hindrance to the storage stability of the thermosensitive recording layer at high temperature and high humidity, at least one of diiodomethyl-p-tolylsulfone and 3-iodo-2-propynyl-butyl-carbamate need to be incorporated as essential components, as the antibacterial agent.

The amount added of the diiodomethyl-p-tolylsulfone and/or 3-iodo-2-propynyl-butyl-carbamate is not particularly limited and may be suitably selected according to the intended purpose. It is preferably 0.04% by mass to 2.0% by mass, more preferably 0.05% by mass to 1.0% by mass, relative to a layer of the thermosensitive recording medium. When the amount is less than 0.04% by mass, antibacterial efficacy may not be exhibited. When the amount is more than 2.0% by mass, the thermosensitive recording medium exhibits greater antibacterial efficacy than necessary, which is not economical.

The diiodomethyl-p-tolylsulfone and 3-iodo-2-propynyl-butyl-carbamate are not particularly limited as long as they are contained in the thermosensitive recording medium, and may be suitably selected according to the intended purpose. It is desirable that they be contained in at least any one of the thermosensitive recording layer, the overcoat layer, the undercoat layer, the back coat layer and the adhesive layer, which constitute the thermosensitive recording medium. It is more desirable that they be contained in the overcoat layer or the adhesive layer, because they can easily come into direct contact with bacteria as the antibacterial agent.

<Antibacterial Agent>

Besides the above-mentioned antibacterial agents, other antibacterial agents may if necessary be added as long as the effects of the present invention are not hindered. Examples of the other antibacterial agents include inorganic antibacterial agents such as silver salt complexes, silver zeolite, antibacterial ceramic, thiabendazole, an imidazole antibacterial agent, magnesium silicate pentahydrate and photocatalytically oxidized titanium; and a pyridine antibacterial agent, a guanidine antibacterial agent, a urea antibacterial agent, an acridine antibacterial agent, a quinoline antibacterial agent and a haloalkylthio antibacterial agent.

The zirconium phosphate antibacterial agent is zirconium phosphate on which an antibacterial metal ion is supported. Examples thereof include silver ion-supported zirconium phosphate, copper ion-supported zirconium phosphate and zinc ion-supported zirconium phosphate, with preference being given to silver ion-supported zirconium phosphate, in other words zirconium phosphate-silver.

<Uses>

Uses of the thermosensitive recording medium of the present invention are not particularly limited and may be suitably selected according to the intended purpose. For instance, the thermosensitive recording medium can be favorably used as a highly practical thermosensitive recording adhesive label or thermosensitive recording paper having excellent storage stability at high temperature and high humidity and antibacterial properties, and is suitable for use with food in the POS system, use in the medical field, or the like.

EXAMPLES

The following explains the present invention in further detail, with reference to Examples and Comparative Examples. However, the present invention is not confined to these Examples. The term "part(s)" and "%" used below are both based upon mass.

[Thermosensitive Recording Paper]

Thermosensitive recording paper was produced in accordance with the formulations of Examples 1 to 11 and Comparative Examples 1 to 3 below.

Example 1

Preparation of Thermosensitive Recording Layer Solution

An A solution and a B solution having the following compositions were each dispersed using a sand mill so as to have an average particle diameter of 2 μm or less, and the A solution serving as a dye dispersion solution and the B solution serving as a developer dispersion solution were thus prepared.

A Solution

| | |
|---|---|
| 6-[ethyl(4-methylphenyl)amino]-3-methyl-2-anilinofluoran | 10 parts |
| 10% aqueous solution of itaconic acid-modified polyvinyl alcohol KL-318, produced by KURARAY CO., LTD. | 10 parts |
| Water | 30 parts |

B Solution

| | |
|---|---|
| 4-hydroxy-4'-isopropoxydiphenylsulfone | 30 parts |
| Di-(p-methylbenzyl) oxalate | 10 parts |
| 10% aqueous solution of itaconic acid-modified polyvinyl alcohol KL-318, produced by KURARAY CO., LTD. | 50 parts |
| Silica | 15 parts |
| Water | 197 parts |

Subsequently, the A solution and the B solution were stirred and mixed together with the following proportion so as to prepare a C solution serving as a thermosensitive recording layer solution.

C Solution

| | |
|---|---|
| A solution as the dye dispersion solution | 50 parts |
| B solution as the developer dispersion solution | 302 parts |

<Preparation of Overcoat Layer Solution>

The following composition was dispersed for 24 hours using a sand mill so as to prepare a D solution.

D Solution

| | |
|---|---|
| aluminum hydroxide having an average particle diameter of 0.6 μm, HIGILITE H-43M, produced by Showa Denko K.K. | 20 parts |
| 10% aqueous solution of itaconic acid-modified polyvinyl alcohol | 20 parts |
| water | 60 parts |

Subsequently, the following composition was mixed and stirred so as to prepare an E1 solution serving as an overcoat layer solution.

E1 Solution

| | |
|---|---|
| D solution | 75 parts |
| 10% aqueous solution of diacetone-modified polyvinyl alcohol | 100 parts |
| 10% aqueous solution of N-aminopolyacrylamide having a molecular weight of 10,000, and a hydrazide ratio of 50% | 15 parts |
| diiodomethyl-p-tolylsulfone | 0.12 parts |

-continued

| | |
|---|---|
| 1% aqueous solution of ammonia | 5 parts |
| water | 105 parts |

<Production of Thermosensitive Recording Paper>

The thermosensitive recording layer solution, i.e. C solution, and the overcoat layer solution, i.e. E1 solution, were applied onto the surface of commercially available wood free paper having a basis weight of 60 g/m$^2$ and serving as a support, and then dried so as to have masses of 2.85 g/m$^2$ and 3.0 g/m$^2$ respectively after dried. Then, the paper with the dried solutions was calendered such that the surface had an Oken-type smoothness of approximately 2,000 seconds, and a thermosensitive recording paper was thus produced.

Example 2

A thermosensitive recording paper was produced in the same manner as in Example 1, except that diiodomethyl-p-tolylsulfone in the overcoat layer solution E1 solution was changed to 3-iodo-2-propynyl-butyl-carbamate.

Example 3

A thermosensitive recording paper was produced in the same manner as in Example 1, except that 6-[ethyl(4-methylphenyl)amino]-3-methyl-2-anilinofluoran in the dye dispersion solution A solution was changed to 3-dibutylamino-6-methyl-7-anilinofluoran.

Example 4

A thermosensitive recording paper was produced in the same manner as in Example 1, except that 6-[ethyl(4-methylphenyl)amino]-3-methyl-2-anilinofluoran in the dye dispersion solution A solution was changed to 6-(N-iso-amyl-N-ethylamino)-3-methyl-2-anilinofluoran.

Example 5

A thermosensitive recording paper was produced in the same manner as in Example 1, except that an undercoat layer solution F1 solution having the following composition was prepared and then applied between the thermosensitive recording layer and the support such that the amount of the solution attached was 3.0 g/m$^2$ after dried and an undercoat layer was thus provided.

<Preparation of Undercoat Layer Solution>

The following composition was mixed and stirred so as to prepare a F1 solution serving as an undercoat layer solution.

F1 Solution

| | |
|---|---|
| non-expandable plastic fine hollow particles, which was a copolymer resin composed mainly of vinylidene chloride and acrylonitrile, and had a hollow ratio of 90%, and a solid content of 32% | 30 parts |
| styrene-butadiene copolymer latex, PA-9159, produced by NIPPON A&L INC., solid content concentration: 47.5% | 10 parts |
| water | 60 parts |

Example 6

A thermosensitive recording paper was produced in the same manner as in Example 5, except that a back coat layer solution G1 solution having the following composition was prepared and then applied onto a surface of the support, which surface was opposite to a surface on which the thermosensitive recording layer was formed, such that the amount of the solution attached was 1.5 g/m$^2$ after dried and a back coat layer was thus provided.

<Preparation of Back Coat Layer Solution>

The following composition was mixed and stirred so as to prepare a G1 solution serving as a back coat layer solution.

G1 Solution

| | |
|---|---|
| 10% aqueous solution of polyvinyl alcohol | 100 parts |
| kaolin, ULTRAWHITE 90, produced by Engelhard Corporation | 10 parts |
| zirconium phosphate-silver | 0.04 parts |
| 2-(4-thiazolyl)-benzimidazole | 0.04 parts |
| water | 90 parts |

Example 7

A thermosensitive recording paper was produced in the same manner as in Example 6, except that the amount of diiodomethyl-p-tolylsulfone in the overcoat layer solution E1 solution was 0.012 parts.

Example 8

A thermosensitive recording paper was produced in the same manner as in Example 6, except that the amount of diiodomethyl-p-tolylsulfone in the overcoat layer solution E1 solution was 0.57 parts.

Example 9

A thermosensitive recording paper was produced in the same manner as in Example 5, except that a F2 solution serving as an undercoat layer solution having the following composition was prepared and then applied between the thermosensitive recording layer and the support such that the amount of the solution attached was 3.0 g/m$^2$ after dried and an undercoat layer was thus provided.

F2 Solution

| | |
|---|---|
| non-expandable plastic fine hollow particles, which was a copolymer resin composed mainly of vinylidene chloride and acrylonitrile, had a hollow ratio of 90%, and a solid content of 32% | 30 parts |
| styrene-butadiene copolymer latex, PA-9159, produced by NIPPON A&L INC., solid content concentration: 47.5% | 10 parts |
| diiodomethyl-p-tolylsulfone | 0.06 parts |
| water | 60 parts |

Example 10

A thermosensitive recording paper was produced in the same manner as in Example 9, except that the overcoat layer solution E1 solution was changed to an E2 solution having the following composition.

E2 Solution

| | |
|---|---|
| D solution | 75 parts |
| 10% aqueous solution of diacetone-modified polyvinyl alcohol | 100 parts |
| 10% aqueous solution of N-aminopolyacrylamide having a molecular weight of 10,000, and a hydrazide ratio of 50% | 15 parts |
| 1% aqueous solution of ammonia | 5 parts |
| water | 105 parts |

Example 11

A thermosensitive recording paper was produced in the same manner as in Example 1, except that the overcoat layer solution, i.e. E2 solution was applied to a thermosensitive recording layer such that the amount of the solution attached was 3.0 g/m$^2$ after dried, that the undercoat layer solution, i.e. F1 solution was prepared and then applied between the thermosensitive recording layer and the support such that the amount of the solution attached was 3.0 g/m$^2$ after dried and an undercoat layer was thus provided, and that a G2 solution serving as a back coat layer solution having the following composition was applied onto a surface of the support, which surface was opposite to a surface on which the thermosensitive recording layer was formed, such that the amount of the solution attached was 1.5 g/m$^2$ after dried and a back coat layer was thus provided.

G2 Solution

| | |
|---|---|
| 10% aqueous solution of polyvinyl alcohol | 100 parts |
| kaolin, ULTRAWHITE 90, produced by Engelhard Corporation | 10 parts |
| diiodomethyl-p-tolylsulfone | 0.08 parts |
| water | 90 parts |

Comparative Example 1

A thermosensitive recording paper was produced in the same manner as in Example 1, except that an E3 solution having the following composition was used as an overcoat layer solution instead of the E1 solution.

E3 Solution

| | |
|---|---|
| D solution | 75 parts |
| 10% aqueous solution of diacetone-modified polyvinyl alcohol | 100 parts |
| 10% aqueous solution of N-aminopolyacrylamide having a molecular weight of 10,000, and a hydrazide ratio of 50% | 15 parts |
| silver-zeolite | 0.12 parts |
| 1% aqueous solution of ammonia | 5 parts |
| water | 105 parts |

Comparative Example 2

A thermosensitive recording paper was produced in the same manner as in Example 1, except that an E4 solution having the following composition was used as an overcoat layer solution instead of the E1 solution.

E4 Solution

| | |
|---|---|
| D solution | 75 parts |
| 10% aqueous solution of diacetone-modified polyvinyl alcohol | 100 parts |
| 10% aqueous solution of N-aminopolyacrylamide having a molecular weight of 10,000, and a hydrazide ratio of 50% | 15 parts |
| hinokitiol | 0.12 parts |
| 1% aqueous solution of ammonia | 5 parts |
| water | 105 parts |

Comparative Example 3

A thermosensitive recording paper was produced in the same manner as in Example 1, except that diiodomethyl-p-tolylsulfone was removed from the E1 solution serving as the overcoat layer solution.

With respect to the thermosensitive recording paper of Examples and Comparative Examples thus produced, the coloring properties test, heat resistance test, and temperature and humidity resistance test were performed as described below. The results are shown in Table 2.

<Coloring Properties Test>

Each sample was printed under a load of 2 kg/cm$^2$ for one second with a thermal block having a temperature at which the sample had a saturation density, using a heat gradient tester manufactured by Toyo Seiki Seisaku-sho, Ltd., so as to produce a pre-test image sample, and the printing density was measured using a Macbeth densitometer RD-914.

<Heat Resistance Test>

The coloring density of the test sample after left to stand for 24 hours at 80° C. was measured using the Macbeth densitometer RD-914, and temperature and humidity resistance was evaluated. The evaluation criteria are as shown in Table 1.

<Temperature and Humidity Resistance Test>

The coloring density of the test sample after left to stand for 48 hours at 40° C. and a relative humidity of 90% was measured using the Macbeth densitometer RD-914, and temperature and humidity resistance was evaluated. The evaluation criteria are as shown in Table 1.

<Antibacterial Efficacy Test>

In accordance with the antibacterial efficacy testing method of Japanese Industrial Standards, JIS Z 2801, the thermosensitive recording paper obtained in Examples and Comparative Examples were each cut into a 5 cm×5 cm square as a specimen. *Escherichia coli* was prepared in such an adjusted manner that the number thereof was 1.5×10$^6$, and applied dropwise to the specimen. Subsequently, a polyethylene film was closely attached to the specimen, which was followed by storage at 37° C., the number of viable bacteria present 24 hours afterward was measured, and the antibacterial activity value was calculated by means of the following equation. The evaluation criteria are shown in Table 1.

$$R=\log(B/A)-\log(C/A)\}=\log(B/C)$$

R: antibacterial activity value

A: average number of viable bacteria on unprocessed specimen immediately after applied B: average number of viable bacteria on unprocessed specimen 24 hours afterward C: average number of viable bacteria on antibacterial specimen 24 hours afterward A front surface and a back surface of each specimen were tested for antibacterial efficacy. The front surface was a surface of the support, on which the thermosensitive recording layer was formed, and a back surface was a surface of the support, which surface was opposite to the surface on which the thermosensitive recording layer was formed.

TABLE 1

| Heat resistance and temperature and humidity resistance | | Antibacterial activity value | |
|---|---|---|---|
| 0.1 or less | A | 4 or greater | A |
| 0.1 or greater but less than 0.2 | B | 3 or greater but less than 4 | B |
| 0.2 or greater but less than 0.3 | C | 2 or greater but less than 3 | C |
| 0.3 or greater | D | less than 2 | D |

TABLE 2

| | Thermosensitive properties | | | | | | | | |
|---|---|---|---|---|---|---|---|---|---|
| | | | | Temperature and | | Antibacterial efficacy | | | |
| | Coloring properties | Heat resistance | | humidity resistance | | Front surface | | Back surface | |
| Ex. 1 | 1.31 | 0.09 | A | 0.08 | A | 4.4 | A | 3.1 | B |
| Ex. 2 | 1.32 | 0.09 | A | 0.08 | A | 3.6 | B | 2.8 | C |
| Ex. 3 | 1.30 | 0.11 | B | 0.12 | B | 4.1 | A | 3.2 | B |
| Ex. 4 | 1.32 | 0.26 | C | 0.19 | B | 4.2 | A | 3.3 | B |
| Ex. 5 | 1.36 | 0.09 | A | 0.09 | A | 4.3 | A | 3.1 | B |
| Ex. 6 | 1.36 | 0.09 | A | 0.08 | A | 4.2 | A | 3.2 | B |
| Ex. 7 | 1.37 | 0.08 | A | 0.08 | A | 2.9 | C | 2.2 | C |
| Ex. 8 | 1.35 | 0.12 | B | 0.11 | B | 4.8 | A | 3.8 | B |
| Ex. 9 | 1.36 | 0.14 | B | 0.13 | B | 4.7 | A | 4.1 | A |
| Ex. 10 | 1.37 | 0.09 | A | 0.09 | A | 3.1 | B | 2.9 | C |
| Ex. 11 | 1.36 | 0.09 | A | 0.08 | A | 3.2 | B | 4.4 | A |
| Comp. Ex. 1 | 1.31 | 0.09 | A | 0.08 | A | 4.4 | A | 1.1 | D |
| Comp. Ex. 2 | 1.32 | 0.45 | D | 0.37 | D | 3.6 | B | 2.3 | C |
| Comp. Ex. 3 | 1.32 | 0.08 | A | 0.08 | A | — | — | — | — |

[Thermosensitive Recording Adhesive Label]

Thermosensitive recording adhesive labels were produced in accordance with the formulations of Examples 12 to 19 and Comparative Examples 4 to 6 below.

Example 12

Production of Thermosensitive Recording Material

The thermosensitive recording layer solution, i.e. C solution and the overcoat layer solution, i.e. E2 solution were applied onto the surface of commercially available wood free paper having a basis weight of 60 g/m$^2$ and serving as a support and then dried so as to have masses of 2.85 g/m$^2$ and 3.0 g/m$^2$ respectively after dried. Then, the paper with the dried solutions was calendered such that the surface had an Oken-type smoothness of approximately 2,000 seconds, and a thermosensitive recording material was thus produced.

<Preparation of Adhesive Layer Solution>

The following composition was mixed and stirred so as to prepare an H1 solution serving as an adhesive layer solution.

H1 Solution

| | |
|---|---|
| diiodomethyl-p-tolylsulfone | 0.12 parts |
| pressure-sensitive adhesive acrylic emulsion, BPW6111, solid content: 60%, produced by TOYO INK MFG. CO., LTD. | 100 parts |

<Production of Thermosensitive Recording Adhesive Label>

Next, the adhesive layer solution was applied onto release paper, LSW, produced by LINTEC Corporation, using a wire bar and dried such that the amount of the solution attached was 20 g/m$^2$ after dried. Then, the release paper coated with the adhesive was attached to a surface of the thermosensitive recording material, which surface was opposite to a surface on which the thermosensitive recording layer was formed and left to stand for 48 hours under a load of 10 kg/(20 cm×30 cm) in a constant-temperature room, i.e. at 23° C. and a relative humidity of 50%, and a thermosensitive recording adhesive label was thus obtained.

Example 13

A thermosensitive recording adhesive label was produced in the same manner as in Example 12, except that an H2 solution having the following composition was used as an adhesive layer solution instead of the H1 solution.

H2 Solution

| | |
|---|---|
| 3-iodo-2-propynyl-butyl-carbamate | 0.12 parts |
| pressure-sensitive adhesive acrylic emulsion, BPW6111, solid content: 60%, produced by TOYO INK MFG. CO., LTD. | 100 parts |

Example 14

A thermosensitive recording adhesive label was produced in the same manner as in Example 12, except that an undercoat layer solution F1 solution was prepared and then applied between the thermosensitive recording layer and the support such that the amount of the solution attached was 3.0 g/m$^2$ after dried and an undercoat layer was thus provided.

Example 15

A thermosensitive recording adhesive label was produced in the same manner as in Example 14, except that a back coat layer solution G1 solution was prepared and then applied onto a surface of the support, which surface was opposite to a surface on which the thermosensitive recording layer was formed, such that the amount of the solution attached was 1.5 g/m$^2$ after dried and a back coat layer was thus provided, followed by attaching the release paper coated with the adhesive thereon.

Example 16

A thermosensitive recording adhesive label was produced in the same manner as in Example 15, except that an H3 solution having the following composition was used as an adhesive layer solution instead of the H1 solution.

H3 Solution

| | |
|---|---|
| diiodomethyl-p-tolylsulfone | 0.024 parts |
| pressure-sensitive adhesive acrylic emulsion, BPW6111, solid content: 60%, produced by TOYO INK MFG. CO., LTD. | 100 parts |

Example 17

A thermosensitive recording adhesive label was produced in the same manner as in Example 15, except that an H4 solution having the following composition was used as an adhesive layer solution instead of the H1 solution.

H4 Solution

| | |
|---|---|
| diiodomethyl-p-tolylsulfone | 1.23 parts |
| pressure-sensitive adhesive acrylic emulsion, BPW6111, solid content: 60%, produced by TOYO INK MFG. CO., LTD. | 100 parts |

Example 18

A thermosensitive recording adhesive label was produced in the same manner as in Example 12, except that the thermosensitive recording material of Example 12 was changed to the thermosensitive recording material, i.e. thermosensitive recording paper of Example 1.

Example 19

A thermosensitive recording adhesive label was produced in the same manner as in Example 12, except that the thermosensitive recording material of Example 12 was changed to the thermosensitive recording material, i.e. thermosensitive recording paper of Example 9.

Comparative Example 4

A thermosensitive recording adhesive label was produced in the same manner as in Example 12, except that an H5 solution having the following composition was used as an adhesive layer solution instead of the H1 solution.

H5 Solution

| | |
|---|---|
| silver-zeolite | 0.12 parts |
| pressure-sensitive adhesive acrylic emulsion, BPW6111, solid content: 60%, produced by TOYO INK MFG. CO., LTD. | 100 parts |

Comparative Example 5

A thermosensitive recording adhesive label was produced in the same manner as in Example 12, except that an H6 solution having the following composition was used as an adhesive layer solution instead of the H1 solution.

H6 Solution

| | |
|---|---|
| hinokitiol | 0.12 parts |
| pressure-sensitive adhesive acrylic emulsion, BPW6111, solid content: 60%, produced by TOYO INK MFG. CO., LTD. | 100 parts |

Comparative Example 6

A thermosensitive recording adhesive label was produced in the same manner as in Example 12, except that diiodomethyl-p-tolylsulfone was removed from the adhesive layer solution, i.e. H1 solution.

<Adhesive Force Test>

Each of the thermosensitive recording adhesive labels was cut into a 25 mm×100 mm rectangle and affixed to an object, which was a steel use stainless (SUS) plate, in a lengthwise direction using a rubber roller with a pressurizing force of 2 kg; 30 minutes after, each label was separated from the object at a separation angle of 180° and a separation rate of 300 mm/min. The adhesive force of each label at that time was measured using a force gauge, data were read at intervals of 0.1 seconds, and the values obtained by averaging the data are shown in Table 3. N/25 mm was used as the unit for the measurement of the adhesive force. The adhesive force test was carried out at normal temperature, i.e., at a temperature of 23° C. and a relative humidity of 50%.

<Antibacterial Efficacy Test>

In accordance with the antibacterial efficacy testing method of Japanese Industrial Standards, JIS Z 2801, the thermosensitive recording adhesive labels obtained in Examples and Comparative Examples were each cut into a 5 cm×5 cm square as a specimen. *Escherichia coli* was prepared in such an adjusted manner that the number thereof was $1.5\times10^6$, and applied dropwise to the specimen. Subsequently, a polyethylene film was closely attached to the specimen, which was followed by storage at 37° C., the number of viable bacteria present 24 hours afterward was measured, and the antibacterial activity value was calculated by means of the following equation. The evaluation criteria are shown in Table 1 above.

$$R=\{\log(B/A)-\log(C/A)\}=\log(B/C)$$

R: antibacterial activity value

A: average number of viable bacteria on unprocessed specimen immediately after applied B: average number of viable bacteria on unprocessed specimen 24 hours afterward C: average number of viable bacteria on antibacterial specimen 24 hours afterward A front surface and an adhesive surface of each specimen were tested for antibacterial efficacy. The front surface was a surface of the support, on which the thermosensitive recording layer was formed, and an adhesive surface was a surface of the support, which surface was opposite to the surface on which the thermosensitive recording layer was formed.

In the same manner as in the thermosensitive recording paper of Examples 1 to 11 and Comparative Examples of 1 to 3, the coloring properties test, heat resistance test, and temperature and humidity resistance test were performed with respect to the thermosensitive recording adhesive labels. The evaluation criteria are shown in Table 1 above.

TABLE 3

| | Thermosensitive properties | | | | | | | | | |
|---|---|---|---|---|---|---|---|---|---|---|
| | | | | Temperature | | Antibacterial efficacy | | | | Adhesive |
| | Coloring properties | Heat resistance | | and humidity resistance | | Adhesive surface | | Thermosensitive recording surface | | Force N/25 mm |
| Ex. 12 | 1.33 | 0.09 | A | 0.12 | B | 4.8 | A | 3.2 | B | 18.7 |
| Ex. 13 | 1.32 | 0.10 | B | 0.13 | B | 4.3 | A | 3.1 | B | 18.2 |
| Ex. 14 | 1.38 | 0.09 | A | 0.14 | B | 3.7 | B | 2.5 | C | 19.3 |
| Ex. 15 | 1.37 | 0.09 | A | 0.15 | B | 3.6 | B | 2.3 | C | 20.2 |

TABLE 3-continued

| | Thermosensitive properties | | | | | | | | | |
|---|---|---|---|---|---|---|---|---|---|---|
| | | | | Temperature | | Antibacterial efficacy | | | | Adhesive |
| | Coloring properties | Heat resistance | | and humidity resistance | | Adhesive surface | | Thermosensitive recording surface | | Force N/25 mm |
| Ex. 16 | 1.38 | 0.09 | A | 0.12 | B | 2.6 | C | 2.2 | C | 20.4 |
| Ex. 17 | 1.38 | 0.09 | A | 0.13 | B | 5.2 | A | 2.9 | C | 20.2 |
| Ex. 18 | 1.32 | 0.09 | A | 0.14 | B | 4.9 | A | 3.3 | B | 18.6 |
| Ex. 19 | 1.38 | 0.09 | A | 0.12 | B | 5 | A | 4.2 | A | 21.1 |
| Comp. Ex. 4 | 1.38 | 0.08 | A | 0.09 | A | 3.4 | B | 1.2 | D | 18.5 |
| Comp. Ex. 5 | 1.37 | 0.33 | D | 0.16 | B | 3.2 | B | 2.1 | C | 18.4 |
| Comp. Ex. 6 | 1.38 | 0.08 | A | 0.08 | A | — | — | — | — | 17.9 |

The thermosensitive recording medium of the present invention is highly practical since it has excellent antibacterial properties and causes no fogging of background portions of images at high temperature and high humidity, and is suitable as a label used with food in the POS system, a label used in the medical field, or the like.

What is claimed is:

1. A thermosensitive recording medium comprising:

a support, a thermosensitive recording layer comprising a leuco dye and a developer, and formed on a surface of the support, and an acrylic adhesive layer disposed on another surface of the support, said another surface being opposite to the surface on which the thermosensitive recording layer is formed, wherein diiodomethyl-p-tolylsulfone is dispersed throughout the acrylic adhesive layer.

2. The thermo sensitive recording medium according to claim 1, wherein the leuco dye comprises at least one of 3-dibutylamino-6-methyl-7-anilinofluoran and 6-[ethyl(4-methylphenyl)amino]-3-methyl-2-anilinofluoran.

3. The thermosensitive recording medium according to claim 1, further comprising an overcoat layer formed on the thermosensitive recording layer.

4. The thermosensitive recording medium according to claim 3, wherein the overcoat layer comprises diiodomethyl-p-tolylsulfone.

5. The thermosensitive recording medium according to claim 1, further comprising an undercoat layer formed between the support and the thermosensitive recording layer.

6. The thermosensitive recording medium according to claim 5, wherein the undercoat layer comprises diiodomethyl-p-tolylsulfone.

7. The thermosensitive recording medium according to claim 1, further comprising a back coat layer formed on a surface of the support, which surface is opposite to a surface on which the thermosensitive recording layer is formed.

8. The thermosensitive recording medium according to claim 7, wherein the back coat layer comprises diiodomethyl-p-tolylsulfone.

9. The thermosensitive recording medium according to claim 1, further comprising release paper formed on the acrylic adhesive layer.

10. The thermosensitive recording medium according to claim 1, further comprising: at least any one of an overcoat layer formed on the thermosensitive recording layer;

an undercoat layer formed between the support and the thermosensitive recording layer; and a back coat layer formed on a surface of the support, which surface is opposite to a surface on which the thermosensitive recording layer is formed.

11. The thermosensitive recording medium according to claim 10, wherein any one of the overcoat layer, the undercoat layer, and the back coat layer comprises diiodomethyl-p-tolylsulfone.

12. A thermosensitive recording medium comprising:

a support, a thermosensitive recording layer comprising a leuco dye and a developer, and formed on a surface of the support, a back coat layer disposed on another surface of the support, and an acrylic adhesive layer disposed on a specific surface of the back coat layer and where said specific surface is opposite to the surface of the support on which the thermosensitive recording layer is formed, wherein diiodomethyl-p-tolylsulfone is dispersed throughout the acrylic adhesive layer.

* * * * *